United States Patent [19]

Harper

[11] Patent Number: 4,642,149

[45] Date of Patent: Feb. 10, 1987

[54] HEAT EXCHANGER WITH RADIAL BAFFLES

[76] Inventor: Jay Harper, 1633 W. 132nd St., Gardena, Calif. 90249

[21] Appl. No.: 786,045

[22] Filed: Oct. 10, 1985

Related U.S. Application Data

[63] Continuation of Ser. No. 370,085, Apr. 20, 1982, abandoned.

[51] Int. Cl.[4] ..... F28D 7/00; F28F 9/22; G05D 15/00

[52] U.S. Cl. ..... 165/160; 165/159; 165/38; 165/916

[58] Field of Search ..... 165/159, 160, 161, 38, 165/DIG. 23, 132

[56] References Cited

U.S. PATENT DOCUMENTS

| | | | |
|---|---|---|---|
| 2,202,494 | 5/1940 | Jacocks | 165/160 |
| 2,293,960 | 8/1942 | Young | 165/132 |
| 2,352,704 | 7/1944 | Garner | 165/38 |
| 4,226,283 | 10/1980 | Furukawa et al. | 165/160 |
| 4,271,901 | 6/1981 | Buchmuller | 165/DIG. 23 |
| 4,298,057 | 11/1981 | Kihlberg et al. | 165/159 |

FOREIGN PATENT DOCUMENTS

| | | | |
|---|---|---|---|
| 0756193 | 2/1971 | Belgium | 165/159 |
| 1501453 | 11/1969 | Fed. Rep. of Germany | 165/160 |
| 0063390 | 5/1980 | Japan | 165/161 |
| 0950548 | 2/1964 | United Kingdom | 165/160 |
| 2034870 | 6/1980 | United Kingdom | 165/160 |
| 0596812 | 2/1978 | U.S.S.R. | 165/160 |

*Primary Examiner*—William R. Cline
*Assistant Examiner*—John K. Ford
*Attorney, Agent, or Firm*—Beehler, Pavitt, Siegemund, Jagger, Martella & Dawes

[57] ABSTRACT

The invention relates to improvements in heat exchangers of the type having a container which defines a cylindrical cavity and a cluster of parallel cooling tubes extending through the cylindrical cavity. The housing is provided with a fluid inlet, a fluid outlet, and a center baffle dividing the cylindrical cavity into an inlet compartment and an outlet compartment. The inlet and the outlet are located on opposite sides of the center baffle, but near one edge thereof. An opening is provided near the opposite edge of the baffle, such that fluid must circulate through a nearly circular path within the cylindrical housing between the inlet and the outlet conduits. A second fluid such as cool air, may be blown through the parallel tubes for removing heat from the fluid in the cavity. The present invention improves over the known heat exchanger structure by providing a number of deflector flanges attached to the cylindrical housing wall and extending radially inwardly therefrom towards the interior of the heat exchanger cavity. The deflector flanges direct fluid away from the housing wall and towards the interior of the coolant tube cluster.

8 Claims, 7 Drawing Figures

HEAT EXCHANGER WITH RADIAL BAFFLES

This is a continuation, of application Ser. No. 370,085, filed Apr. 20, 1982, now abandoned.

BACKGROUND OF THE INVENTION

1. Field of the Invention

The present invention relates to improvements in heat exchangers of the type wherein a first fluid is circulated through a cavity through which pass conduits carrying a second fluid, such that a heat exchange takes place between the two fluids. More particularly the invention relates to improvements in a heat exchanger wherein a core cavity is at least partly bounded by an arcuate wall such that the first fluid is directed in an arcuate path generally parallel to the arcuate wall.

2. State of the Prior Art

It is known to construct heat exchangers wherein a cylindrical cavity is defined within a container including a fluid inlet and a fluid outlet spaced circumferentially from each other on the cylindrical container wall. The cylindrical cavity of the prior art heat exchanger is partitioned into two equal semicylindrical compartments by a diametrically extending center baffle. The center baffle has two diametrically opposed edges, the upper one of which is joined to the cylindrical container wall between the inlet and the outlet. The fluid inlet and the fluid outlet conduits enter through a cylindrical wall into the heat exchanger cavity near the upper edge of the center baffle but on opposite sides thereof. The opposite, lower edge of the baffle is shaped to define an aperture between the two compartments so that fluid introduced into the first compartment through the inlet circulates in a generally arcuate path through the first compartment then passes to the second compartment through the aperture in the opposite edge of the baffle and continues through the second compartment, still in a generally arcuate path, finally exiting the core cavity through the outlet opening.

The housing of the prior art heat exchanger further includes two end walls which may be planar and parallel to each other to define a right cylinder. A number of relatively small diameter cooling tubes of a thermally conductive material, such as aluminium, extend through the core cavity between the end walls. A stream of fluid such as air may be circulated through the cooling tubes where it is brought into thermal contact with the fluid circulating through the core cavity, so that a thermal exchange takes place between the two fluids. In a particular heat exchanger construction known to the prior art, the inlet and outlet are circumferentially separated by a relatively small angle, e.g. less than forty five degrees. The fluid entering the core cavity through the inlet must therefore flow through a generally arcuate path in excess of 270 degrees before reaching the outlet. The fluid is directed in this arcuate path by the cylindrical peripheral wall.

It has been found that excessive fluid flow takes place close to the peripheral wall while the fluid in the central area of the core cavity is relatively stagnant. This is detrimental to the cooling efficiency of the heat exchanger because relatively little cooling or heat exchange takes place at or through the peripheral wall, which has a relatively small surface area compared to the aggregate surface of the cooling or heat exchange tubes extending through the core cavity.

It is also known to introduce "turbolator" elements into heat exchange tubing for the purpose of increasing the turbulence of the coolant fluid to thereby increase the heat transfer from the tubing to the coolant fluid. This occurs because fluid flowing through the center of the tube is directed against the tube walls where it absorbs heat. If the flow were not disturbed by the turbolator element the centrally flowing coolant fluid would be relatively insulated by the coolant fluid flowing adjacent to the tube walls.

Previously used turbolator elements known to the Applicant include coil springs positioned coaxially within the heat exchange tubing. While such structures brought about increased turbulence, the coil element also diminished the aperture of the tubing, partly obstructing fluid flow, and also encouraged eventual clogging of the tube because the coil tends to accumulate particulate matter carried by the coolant fluid.

SUMMARY OF THE INVENTION

The improvements of this invention comprise the installation of radially extending flanges mounted to the arcuate peripheral wall of the heat exchanger housing. These radial flanges operate as flow deflector baffles projecting from the peripheral wall into the core cavity to redirect the fluid flow away from the peripheral wall and towards the interior of the core cavity.

It has been found that the efficiency of the heat exchanger can be further improved by correlating the placement of such radially extending deflector flanges to the angle of entry of the fluid into the core cavity. In a heat exchanger having an inlet angle of thirty degrees, marked improvement was realized by providing four flanges on the peripheral wall, two flanges in each compartment spaced approximately 47 degrees from the upper and lower edges of the center baffle, respectively. Surprisingly, the efficiency of the heat exchanger was further increased by a reduction in the number of heat exchange tubes previously considered desirable and an increase in the spacing between the individual heat exchange tubes. In particular, a space free of heat exchange tubing may be provided about each of the flow deflector flanges, so as not to interfere with the flow deflecting function of the radial flanges. The overall weight of the heat exchanger improved according to this invention is thereby reduced, which is of considerable benefit in aircraft hydraulic systems.

Finally, turbolator elements of novel configuration may be inserted into some or all of the heat exchange tubes for facilitating the heat transfer from the tubes to the coolant fluid.

DETAILED DESCRIPTION OF THE INVENTION

Figure 1:
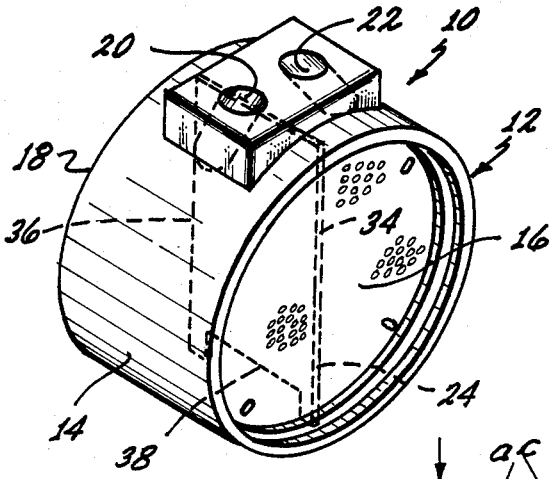
FIG. 1 is a perspective view of the improved heat exchanger.

With reference to FIG. 1 of the drawings a heat exchanger 10 improved according to the present invention comprises a cylindrical housing 12 which includes a cylindrical peripheral wall 14 extending between two planar mutually parallel end walls 16 and 18. The housing 12 further comprises a fluid inlet 20 and a fluid outlet 22 which enter the peripheral wall 14 in mutually divergent directions, as better seen in FIG. 2.

Figure 2:
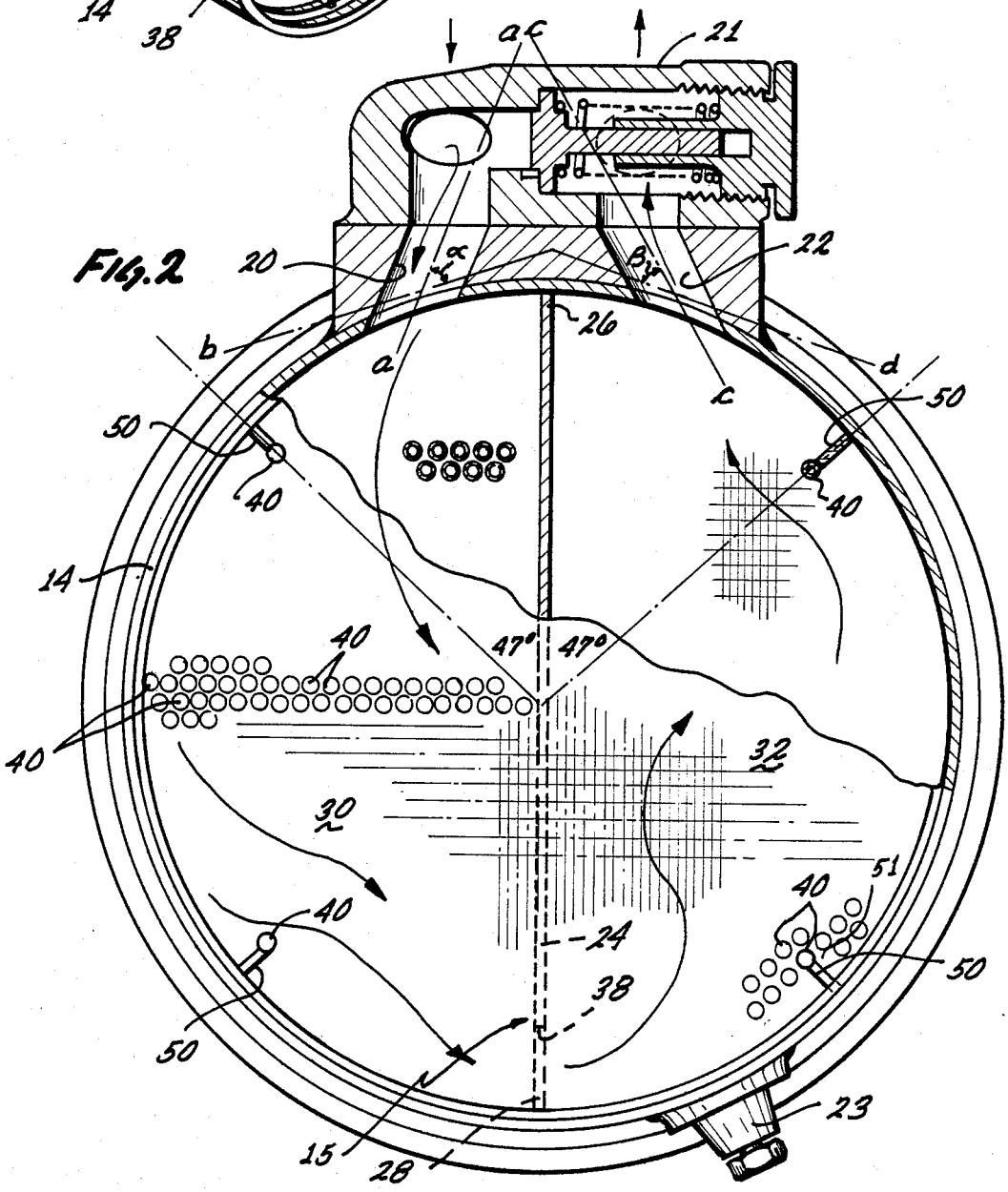
FIG. 2 is an axial cross section of the heat exchanger showing the core cavity and the radial flanges mounted to the peripheral wall.

FIG. 2 of the drawings, is an axial cross section of the heat exchanger of FIG. 1 which is seen to comprise a diametric baffle 24 extending between an upper edge 26 and a lower edge 28 to partition the cylindrical core cavity 15 defined by the housing 12 into a first compartment 30 and a second compartment 32. In the illustrated embodiment, the diametric baffle 24 defines a plane of symmetry between the inlet and outlet sides of the heat exchanger. The fluid inlet conduit 20 enters the peripheral wall 14 and directs fluid into the semicylindrical compartment 30 along arrow a—a which forms an angle $\alpha$ with the tangent line b—b. The outlet conduit axis c—c forms an angle $\beta$ equal to $\alpha$ with the tangent line d—d. The heat exchanger also includes a drain plug assembly 23 which is normally closed.

Figure 3:
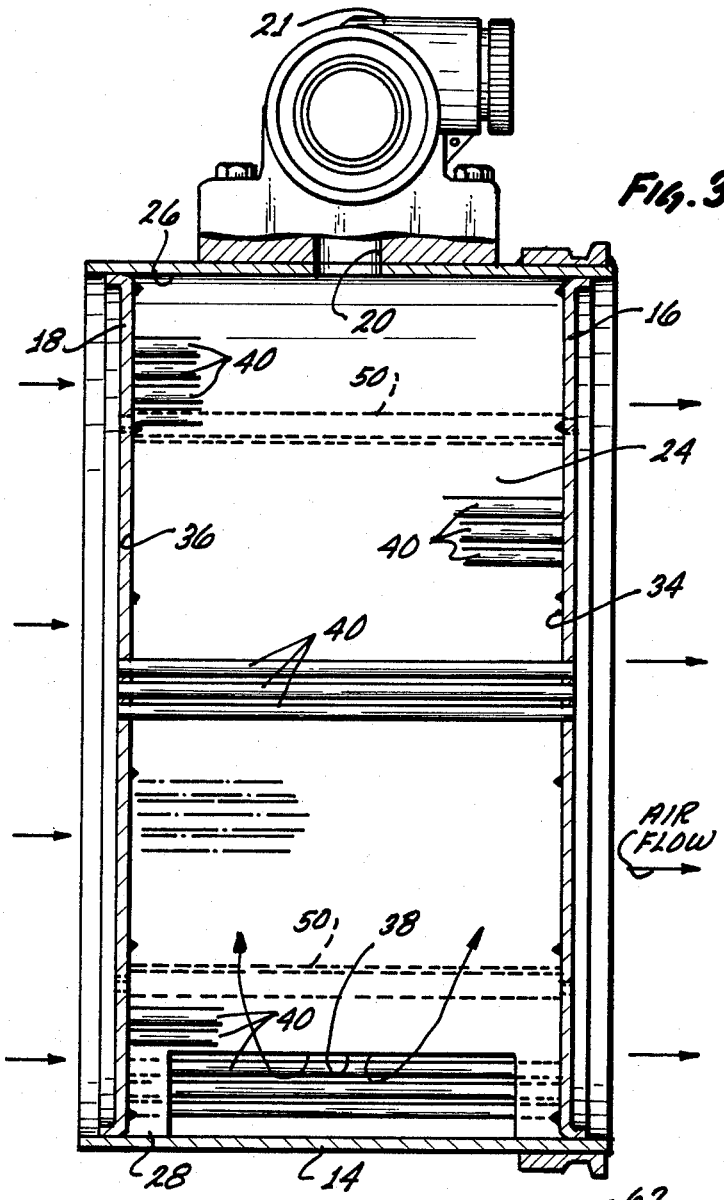
FIG. 3 is a side elevational cross section of the heat exchanger of this invention showing the center baffle.

As best seen in FIG. 2, the diametric baffle 24 is joined at its upper edge 26 to the peripheral wall 14 midway between the circumferentially spaced inlet and outlet openings. The baffle also contacts the two parallel end walls 16 and 18 along its sides 34 and 36, respectively. The lower edge 28 of the baffle is cut out to define an aperture 38, which may be an elongated rectangular aperture, best seen in FIG. 3 to permit fluid to flow from the inlet compartment 30 to the outlet compartment 32 at a point diametrically opposite to the inlet and outlet openings. From the afore described geometry it will be appreciated that fluid entering the heat exchanger cavity 15 through the inlet 20 must flow through the first semicylindrical compartment 30, then flow through the baffle aperture 38 into the second semicylindrical compartment 32, eventually to exit through the outlet 22. The fluid thus describes a nearly circular, arcuate path through the heat exchanger cavity.

The heat exchanger cavity 15 is traversed by a relatively large number of heat exchange conduits 40 which are generally parallel to one another and extend between the end walls 16 and 18 fully through the heat exchanger cavity. Each of the conduits 40 is open at both ends to the exterior of the heat exchanger but does not communicate with the interior heat exchanger cavity 15. Thus, a first fluid circulating through the two compartments 30 and 32 may be placed into thermal heat exchanging contact with a second fluid circulating through the conduits 40. In a typical application a liquid, such as hot hydraulic fluid, is circulated through the heat exchanger cavity 15 in the manner described above through the inlet and outlet 20, 22 respectively. A fan or blower is positioned for circulating cooler air through the parallel tubes 40 in the direction indicated by the arrows in FIG. 3. The air flows through the heat exchanger tubes 40 in thermal contact with the fluid circulating through the heat exchanger compartments 30 and 32 and being at a lower temperature than the fluid carries off heat from the fluid. It is understood that fluids other than air may be circulated through the heat exchanger tubes 40 and that in some applications the second fluid passing through the tubes 40 may be at a higher temperature than the first fluid circulated through the heat exchanger cavity to thereby increase the temperature of the first fluid.

It has been found that fluid circulated through the compartments 30 and 31 in the afore described structure tends to flow near the peripheral wall 14 in a circular path between the inlet and outlet and through the bottom opening 38 in the baffle panel 24. This circulation path is detrimental to the efficiency of the heat exchanger because the fluid present in the center of the exchanger cavity 15 and in contact with the centrally located heat exchanger tubes 40 is relatively stagnant or circulating at a lower rate of flow than the fluid which is closer to the peripheral wall 14. The peripheral wall is not as effective to remove heat from the circulating fluid as the aggregate outer surface of the heat exchanger tubes 40. The overall efficiency of the heat exchanger would therefore be substantially improved if fluid flow where increased through the center of the heat exchanger tube cluster. This problem may be corrected by the addition of radial flanges 50 mounted to the cylindrical peripheral wall 14 such that the flanges extend radially inwardly into the heat exchanger cavity 15. The intended purpose of the radial flanges is to redirect fluid flow away from the peripheral wall 14 and towards the interior of the heat exchanger cavity in the general pattern suggested by the arrows in FIG. 2, so as to increase fluid flow through the center of the heat exchanger tube cluster.

In one embodiment of the invention optimal results were obtained by the provision of four such radial flanges 50, two in each compartment 30 and 32 respectively symmetrically mounted at between 40 degrees and 55 degrees and approximately at a 47 degree angle measured from the upper and lower edges 26 and 28 respectively of the center baffle 24. Preferably the radial flanges are made of metallic sheet having a thickness of 0.068 inches and extending radially approximately 0.035 inches from the peripheral wall 14, and extending the full axial length of the cylindrical cavity between the two end walls 16 and 18. These flange dimensions have been found to substantially increase the efficiency of a heat exchanger having a cavity inside diameter of 9.516 inches, the peripheral cylinder wall having an outside diameter of 9.760 inches. The four flanges 50 desirably are affixed to the cylinder wall 14 by brazing thereto, and may also be further secured at their radially inner edge by brazing to one conveniently located heat exchanger tube 40.

A heat exchanger of the prior art having the given cavity dimensions was previously believed to require 1,280 coolant or heat exchanger tubes 40 of aluminium having an outside diameter of 0.218 inches and an aluminium wall thickness of 0.015 inches. The tubes were mutually parallel and equally spaced approximately 0.030 to 0.050 inches from one another in a rectangular grid such as shown in FIG. 2. The tubes 40 were mounted parallel to the cylinder axis of the heat exchanger housing, as in FIG. 3.

Using the flange arrangement disclosed herein it was possible to reduce the number of heat exchange tubes 40 from the previous 1,280 to only 760 tubes of the same size as that previously used in the prior art heat exchanger. The spacing between the outside walls of individual tubes 40 however, was increased from approximately 0.040 inches in the prior art construction to 0.100 inches, measured along a line joining the centers of the adjacent tubes. The increased spacing between the heat exchanger tubes coupled with the improved flow characteristics obtained through the correlated positioning of the radial flanges results in a substantially improved heat exchanger device.

It was also found beneficial to leave a space 51 free of heat exchange tubes 40 about each of the radial flanges 50. It is believed that such empty space 51 enhances the flow deflection characteristics of the radial flanges 50. The free space 51 is shown in FIG. 2 for only one of the flanges 50, but it will be understood that a similar free space also exists about the remaining flanges 50. The volume of the free space 51 may be equivalent to that which would be occupied by at least one heat exchange tube 40 on each side of the flange 50.

The reduction in the number of the heat exchanger tubes 40 has also resulted in a reduction in overall weight of the heat exchanger from a previous 13 pounds to approximately 10 pounds to 10 pounds 2 ounces. This reduction in weight is important since this type of heat exchanger is commonly used in aircraft hydraulic systems where weight is a critical factor.

The heat exchanger of the prior art typically operated at approximately 132 to 152 degrees Fahrenheit for a flow rate of up to 20 gallons of hydraulic fluid per minute through the heat exchanger cavity. A heat exchanger was improved according to the present disclosure and was able to drop the temperature of the hydraulic fluid to a temperature of 102–106 degrees Fahrenheit, within a time period of two minutes compared to a figure of 132 degrees Fahrenheit for the prior art heat exchanger under similar conditions. In general, the temperature of the hydraulic fluid was dropped at least by an additional 20 degrees as a result of the improvements disclosed herein.

It appears that the optimum circumferential spacing of the radial flanges 50 from the upper and lower edges of the center baffle 24 is related to the entrance angle of the fluid into the heat exchanger cavity 15. Thus, in the present heat exchanger the fluid enters the first compartment 30 through the inlet conduit 20 at an angle $\alpha$ of 30 degrees measured relative to a line b—b tangent to the cylindrical peripheral wall 14 at the point of entry of the inlet axis a—a. The fluid outlet 22 is a mirror image of the fluid inlet 20, the plane of the center baffle 24 being the mirror plane. Thus, the outlet axis c—c is also at an angle $\beta$ of 30 degrees with line d—d which is tangent to the cylindrical peripheral wall at the intersection of the outlet axis c—c with the peripheral wall.

Figure 7:
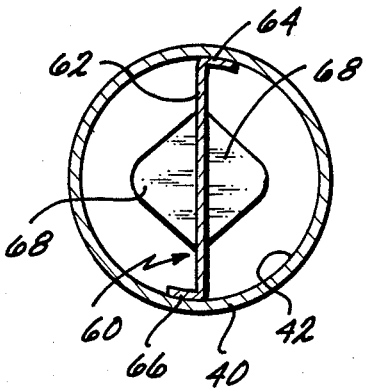
FIG. 7 is a cross section of a turbolator element taken along line 7—7 in FIG. 5.
Figure 4:
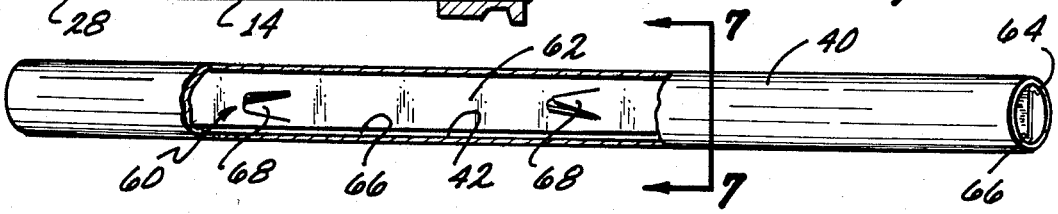
FIG. 4 is a view of a heat exchanger tube broken away to show a turbolator element in its interior.
Figure 5:
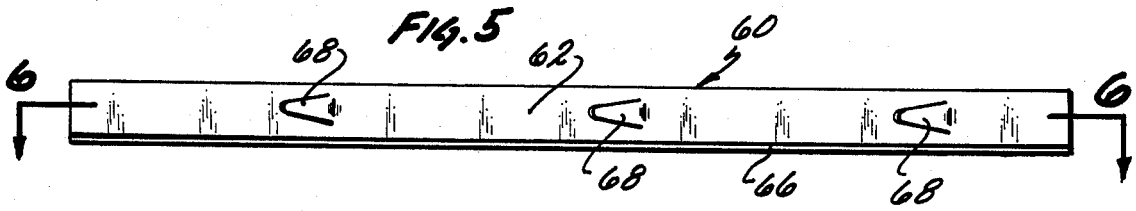
FIG. 5 is a side view of a turbolator element.
Figure 6:
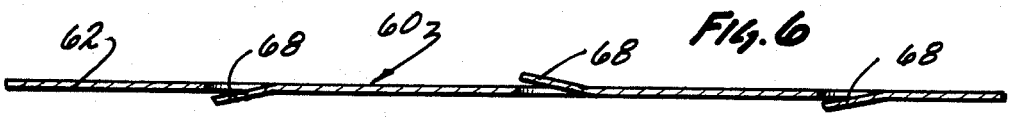
FIG. 6 is a section taken along line 6—6 in FIG. 5 showing the tabs projecting at an angle from the strip.

A further increase in heat exchanger efficiency was obtained by the insertion of novel "turbolator" elements 60 into the heat exchanger tubes 40, as shown in FIGS. 4 and 7. Each turbolator 60 consists of a strip 62 of copper or other heat conductive material extending axially through the coolant tube 40, preferably through the full length thereof. The strip 62 extends across the diameter of the tube 40, as shown in FIG. 7 and is provided with flanges 64, 66 which contact the inner wall surface 42 of the heat exchanger tube 40 in a friction fit. The flanges 64 and 66 extend from the upper and lower edges respectively of the strip 62 and are preferably made of a resilient material. Thus, the flanges may normally project at approximately a right angle to the strip, but are bent as shown in FIG. 7 upon insertion of the turbolator into the tube 40, such that the turbolator is retained therein in a friction fit and the flanges are in positive contact with the tube wall under spring tension to thereby establish a low resistance path for heat flow from the tube 40 into the diametric strip 62. The flanges 64, 66 also provide an enlarged contact surface between the turbolator strip 62 and the heat exchanger tube 40 for more effective transfer of heat from the heat exchanger tube to the turbolator strip. The turbolator element 60 is desirably made of bronze copper sheet which is a better heat conductor than the aluminium wall of the tube. The turbolator operates as a heat sink to carry heat from the heat exchanger tube through the strip itself considerably increasing the surface area in contact with the coolant fluid, further aiding heat transfer. The diametrically extending strip 62 may be deformed at axially spaced intervals such as by having tabs 68 punched out and alternately bent to one side or the other of the strip, such that the tabs project into the fluid circulating through the heat exchanger tube 40. The projecting tabs introduce turbulence into the fluid flow through the tube 40 which also increases the transfer of heat, as had been described. Preferably, the tabs extend at an angle in the direction of fluid flow so as not to oppose the flow. The strip 62 can be made of relatively thin sheet metal so as to minimize obstruction presented by the turbolator in the tube 40. The turbolator structure disclosed herein thus performs a dual function: disturbance of the fluid flow through the heat exchanger tube and enlargement of the surface area exposed to the fluid i.e. a heat sink function.

While a particular embodiment of the invention has been shown and described it will be understood that various changes, modifications and substitutions can be made without departing from the spirit and scope of the invention. Applicant, therefore, intends to be bound only by the following claims.

What is claimed is:

1. A shell and tube type of heat exchanger in which ambient air is used as the cooling medium, comprising:

a housing including a cylindrical peripheral wall having spaced parallel end walls forming a cylindrical core cavity, a fluid inlet and outlet means mounted on said housing for flow of fluid into and out of said cavity, a planar baffle mounted in said cavity and contacting said peripheral wall to divide said cavity into two chambers, said inlet means communicating with one chamber and said outlet means communicating with the other of said chambers, said end walls including a plurality of spaced apertures and having a face exposed to ambient air, a plurality of heat exchanger tubes mounted in said end walls and extending into said cavity and disposed in parallel relation between said end walls, said tubes being open at each end for passage through said tubes of ambient air to effect cooling of the fluid flowing through said cavity, said baffle having an aperture therein located to form a passageway from one to the other of said chambers in a region remote from said inlet and outlet means, each chamber including at least two spaced flanges extending radially inwardly of said cavity from said peripheral wall, at least the flanges closest to said inlet and outlet means being positioned between 40 and 55 degrees on either side of said baffle as measured from the center line of said cavity, and said inlet and outlet means each defining a conduit having an axis which is at an angle of about 30 degrees relative to a line tangent to said peripheral wall at the intersection of said axis with said peripheral wall.

2. A heat exchanger as set forth in claim 1 in which the two flanges closest to the inlet and outlet means are located approximately 47 degrees on either side of said baffle.

3. A heat exchanger as set forth in claim 1 in which each flange includes a radially extending inner edge which is attached to one of the tubes extending through said cavity.

4. A heat exchanger as set forth in claim 1 in which there is a space free of heat exchange tubes about each of said radial flanges.

5. A heat exchanger as set forth in claim 1 wherein each of said heat exchanger tubes are spaced 0.100 inches from each other.

6. A heat exchanger as set forth in claim 5 wherein said heat exchange tubes have an outside diameter of approximately 0.218 inches.

7. A heat exchanger as set forth in claim 6 wherein said cavity has an inside diameter of approximately 9.54 inches.

8. A heat exchanger as set forth in claim 1 in which said baffle defines a plane of symmetry between said inlet and outlet means.

* * * * *